US005990428A

United States Patent [19]

Hayashi et al.

[11] Patent Number: 5,990,428

[45] Date of Patent: Nov. 23, 1999

[54] PRESSURE SWITCH FOR HYDRAULIC PUMP

[75] Inventors: Tetsuji Hayashi; Kenichi Kuga, both of Tokyo, Japan

[73] Assignee: Kayaba Kogyo Kabushiki Kaisha, Tokyo, Japan

[21] Appl. No.: 09/091,743

[22] PCT Filed: Dec. 13, 1996

[86] PCT No.: PCT/JP96/03654

§ 371 Date: Nov. 2, 1998

§ 102(e) Date: Nov. 2, 1998

[87] PCT Pub. No.: WO97/24744

PCT Pub. Date: Oct. 7, 1997

[30] Foreign Application Priority Data

Dec. 27, 1995 [JP] Japan ..... 7-352044

[51] Int. Cl.[6] ..... H01H 35/38

[52] U.S. Cl. ..... 200/82 R; 73/745

[58] Field of Search ..... 73/744, 745; 92/5 R; 200/81 R, 82 R, 82 B, 82 C, 82 D

[56] References Cited

U.S. PATENT DOCUMENTS

| | | | |
|---|---|---|---|
| 4,724,289 | 2/1988 | Heissler | 200/82 R |
| 4,752,658 | 6/1988 | Mack | 200/82 R |
| 4,827,093 | 5/1989 | Strzodka | 200/82 C |
| 5,187,337 | 2/1993 | Fujie et al. | 200/82 R |
| 5,321,220 | 6/1994 | Sekiguchi | 200/82 R |

FOREIGN PATENT DOCUMENTS

| | | | |
|---|---|---|---|
| 61-36040 | 10/1986 | Japan | H01H 35/38 |
| 62-57352 | 4/1987 | Japan | H01H 35/38 |
| 1-165542 | 11/1989 | Japan | H01H 35/38 |
| 1-168935 | 11/1989 | Japan | H01H 35/30 |
| 3-76345 | 7/1991 | Japan | H01H 35/28 |
| 5-12968 | 1/1993 | Japan | H01H 35/38 |

*Primary Examiner*—Michael Friedhofer
*Attorney, Agent, or Firm*—Rabin & Champagne P.C.

[57] ABSTRACT

An easily assembled, low cost pressure switch for a hydraulic pump is proposed. An oil pressure introducing hole is provided for leading a discharge pressure to a depression formed in a body which is earthed. A plug supporting an electrically conducting terminal in an insulated state so as to block the depression, comprises a cylindrical part opening into the depression of the body. An electrically conducting sleeve which is pierced by a damping orifice connected to the oil pressure introducing hole, engages with an opening of the cylindrical part. An electrically conducting plunger which comes in contact with and separates from the terminal in response to an oil pressure from the damping orifice, is housed in the sleeve. A spring pushing the plunger against the oil pressure is housed in the cylindrical part of the plug, and the lower end of the sleeve engages with the opening of the oil pressure introducing hole.

14 Claims, 8 Drawing Sheets

PRESSURE SWITCH FOR HYDRAULIC PUMP

BACKGROUND OF THE INVENTION

This invention relates to a pressure switch for a hydraulic pump, and in particular relates to improvements to a pressure switch of a vane pump which is most suitably used as an oil pressure source for vehicle power steering devices.

BACKGROUND TECHNIQUE

Conventionally, vehicles such as automobiles are provided with a power steering device using oil pressure. A vane pump is used as an oil pressure source for such power steering devices.

In an engine functioning as a drive source for such a vane pump, there is a possibility of stalling due to load rise caused by steering when idling. In order to prevent this, a pressure switch is used to detect the variation of discharge pressure (supply pressure) due to steering when idling and to increase the idle rotation speed of the engine. An example of such a pressure switch is shown in FIG. 9.

An electrically grounded body 100 of this pressure switch houses a vane pump cartridge. A depression 100A in the body 100 is connected to a pump discharge (high pressure) side via a high pressure passage 120, and connected to a pump intake (low pressure) side via a low pressure passage 130 respectively. A plug 102 screws into the depression 100A via a threaded part which is formed in the circumference of the plug 102.

The plug 102 is provided with a throughhole 102A effectively in its central part. On the inner circumference of this throughhole 102A, a conducting terminal 103 is supported in an insulated state via insulation members 105, 107 and O ring 106. The terminal 103 is fixed to the plug 102 by a push nut 104.

In a small diameter part 100B of depression 100A is housed a conducting piston 110 and plunger 109 that can displace in an axial direction facing the aforesaid terminal 103. A spring 111 to push the plunger 109 and terminal 103 apart from each other is interposed between the plunger 109 and terminal 103.

The piston 110 receives a thrust due to oil pressure of the high pressure passage 120 at its base end, displaces, and its tip comes in contact with the plunger 109. When the oil pressure applied to the high pressure passage 120 exceeds a predetermined value, the plunger 109 pressed by the piston 110 displaces to the upper part of the figure against the pushing force of the spring 111, and the terminal 103 comes in contact with the plunger 109. Due to this, the terminal 103 changes into a conducting state via the body 100, piston 110 and plunger 109. A circuit connected to the terminal 103 switches ON, and it is detected that the supply pressure of the vane pump has exceeded a predetermined value.

In this pressure switch, an oil chamber 101 formed between the plunger 109 and plug 102 connects with the low pressure passage 130 of the vane pump.

However, the conventional pressure switch shown in FIG. 9 is associated with the following problems.

Firstly, this pressure switch, terminal 103, spring 111, plunger 109 and piston 110 are each comprised of different parts. Therefore, when the pressure switch is assembled, these parts need to be assembled in a predetermined order. Hence, the number of assembly steps increases and there is a possibility of assembly errors.

Moreover, the long, narrow high pressure passage 120, and the small diameter part 100B housing the small diameter piston 110 and plunger 109 with guide flange, have to be machined inside the body 100. It is also necessary to machine the slanting low pressure passage 130 relative to the axis of the high pressure passage 120. Therefore, the number of machining steps increases, and production cost increases.

Also to improve the operating performance of the plunger 109 and piston 110, the holes for guiding these parts must be machined with higher precision and the parts themselves have to fit together more precisely, which again requires more machining steps and higher cost.

Further, when the spring 111 has low orthogonality, engaging or other assembly defects occur when the plug 102 is tightened, and the production line may have to be temporarily shut down which leads to lower productivity.

On the other hand, Jikko Sho 61-36040 discloses a pressure switch of the type shown in FIG. 10.

An insulating plug 204 which supports a terminal 212 is joined to a conducting case 201. A plunger 208 housed inside this conducting case 201 displaces according to oil pressure applied to an oil pressure introducing hole 205A, and a piston 210 in contact with one end of the plunger 208 comes in contact with and separates from the terminal 212.

An orifice member 220 having a damping orifice of small diameter is interposed between the conducting case 201 and pump body 200. Due to this, a pressure chamber 205B is formed between the oil pressure introducing hole 205A and plunger 208. The pressure chamber 205B prevents unnecessary switching due to fluctuation of supply pressure.

However, in the pressure switch shown in FIG. 10, the damping orifice member 220 is interposed between the body 200 and case 201. It is therefore difficult to insert the damping orifice member 220 deep in the body without it being slanted, so ease of assembly and productivity are adversely affected. There is a possibility that the damping orifice member 220 will be forgotten in the assembly process.

Also, the plunger 208 and piston 210 are comprised of different parts. Therefore, even if the case 201 and plug 204 are pre-assembled in a sub-assembly, there is a possibility that parts will be left out or fall out when the plunger 208 is assembled in the body 200. This again increases the number of assembly steps and verification procedures, which causes a large loss of productivity.

It is therefore an object of this invention, which was conceived in view of the above problems, to provide a pressure switch for a hydraulic pump which as far as possible reduces the number of body machining steps, and which can be easily assembled without error.

It is a further object of this invention to provide a pressure switch for a hydraulic pump having a good response to oil pressure, and which does not fail to operate.

DISCLOSURE OF THE INVENTION

This invention provides a pressure switch for a hydraulic pump comprising a depression forming an opening in the body of the hydraulic pump which is electrically grounded, an oil pressure introducing hole for leading the discharge pressure of the pump to the depression, a plug which engages with the aforesaid depression so as to block the opening of the aforesaid depression, a terminal which is supported in the plug such that it is insulated, and functions as output terminal of an electrical signal, and a plunger comprising an electrically conducting member which displaces according to oil pressure from the oil pressure introducing hole and which is contactable with the terminal. When the terminal comes in contact with the plunger, an electrical signal switches ON or OFF. The pressure switch further comprises a cylindrical part formed in the plug which opens towards the depression in the body, a sleeve formed of an electrically conducting member whereof the upper end engages with an opening of the cylindrical part and the lower end faces and engages with the opening in the oil pressure introducing hole, and which houses a plunger, a damping orifice which pierces the sleeve, connects the sleeve and oil pressure introducing hole, and causes an oil pressure from the oil pressure introducing hole to act on the plunger, while absorbing minute oil pressure fluctuations and a spring housed in the cylindrical part of the plug which pushes the plunger against the oil pressure. Oil pressure is supplied to the plunger via the damping orifice formed directly in the sleeve and ON/OFF operation of an electrical circuit can be performed by bringing the plunger into contact with and separating it from the terminal according to the oil pressure led from the oil pressure introducing hole. Even if there are minute oil pressure fluctuations led from this oil pressure introduction hole, this oil pressure fluctuation is absorbed in the damping orifice and unnecessary switching of the electrical circuit is prevented. Also, as all the contact parts of the pressure switch are formed in the plug, the plug is assembled in the body merely by engaging the lower end of the sleeve with the opening in the pressure introducing hole, and screwing a threaded part on the outer circumference of the plug into the depression in the body. Therefore, there is no need for complicated procedures such as assembling a large number of parts comprising the pressure switch in the assembly of the oil pump as in the aforesaid prior art. Assembly errors or falling out of parts as in the prior art are avoided as the pressure switch can be assembled easily without fail, and the number of steps involved in assembling the pressure pump is largely reduced. Inspection for faulty assembly as in the prior art is rendered unnecessary, productivity is improved, and manufacturing costs are largely reduced. The plug is formed via a sub-assembly so that there is no relationship between the machining precision of holes in the body and the engaging precision of the plunger in the contact parts. High precision is not required to control the machining of engaging parts of the body and plug, so the reliability of the pressure switch is improved.

According to an aspect of this invention, a female screw is formed in the inner circumference of the depression, a male screw is formed in the outer circumference of the plug, and the axis of the depression is made to coincide with the axis of the oil pressure introducing hole. Therefore, in the depression of the body to which the plug is joined, only the female screw which screws into the male screw on the outer circumference of the plug, and the opening in the oil pressure introducing hole which receives the lower end of the plug, require machining. Further, as the axis of the depression in the body and the axis of the oil pressure introducing hole coincide, the plug which forms the oil pressure switch can be easily assembled without fail simply by screwing the plug in. Therefore, not only is productivity improved, but also the number of steps required to machine the body to fit the pressure switch is considerably reduced, and manufacturing costs are further lowered.

According to another aspect of this invention, a notch is formed at a predetermined position of the sleeve to release internal pressure of the plug, and a low pressure passage connecting with the notch is formed in the depression of the body, the low pressure passage and oil pressure introducing hole being arranged substantially parallel. Therefore, pressure oil which has leaked from the sliding parts of the plunger is discharged to the outside of the plug via the notch, and internal pressure does not build up. As the low pressure passage connecting the notch opens into the depression of the body, leaked oil is recirculated to the low pressure side (intake side) of the pump cartridge via this low pressure passage. Further, as this low pressure passage and oil pressure introducing hole are formed substantially parallel, when the body is formed by diecasting, the depression, oil pressure introducing hole and low pressure passage may be simultaneously demolded. This further reduces the number of machining steps after forming the pump body.

According to yet another aspect of this invention, the sleeve comprises a cylindrical flange in which notches are formed, and a disk-shaped spacer interposed between the flange and plunger. These notches are formed by parallel faces at opposite positions on the side wall of the flange, and plural notches are also formed on the outer circumference of the spacer. When the flange of the sleeve is superposed on the spacer to assemble the pressure switch, the notches of the sleeve and the notches of the spacer always have effectively the same size overlap regardless of the positional relationship between the sleeve and spacer in the rotation direction. This overlap part forms a passage through which pressurized oil which has leaked from the sliding surfaces of the plunger is led to the low pressure passage. Therefore, in a step for arranging the overlap between the sleeve and spacer, there is no need to adjust the positional relationship between these parts in the rotation direction, the pressure switch assembly step is simplified, and manufacture of the pressure switch is even easier.

PREFERRED EMBODIMENTS OF THE INVENTION

This invention will now be described in more detail referring to the attached drawings.

FIG. 1–FIG. 4 show one embodiment of a pressure switch to which this invention is applied.

Figure 1:
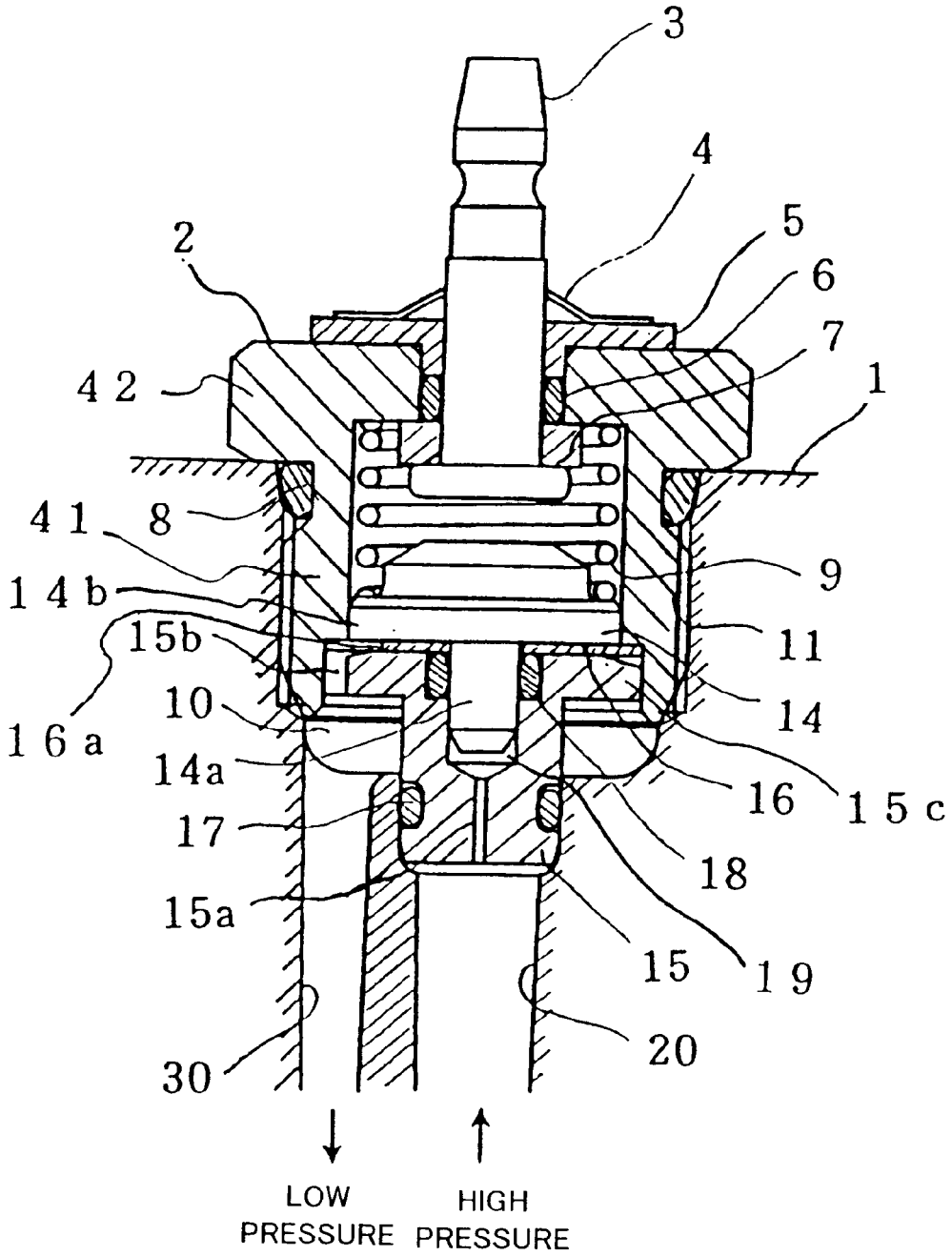
FIG. 1 is a cross sectional view of a pressure switch according to an embodiment of this invention.

In FIG. 1, a pump body 1 houses a vane pump cartridge, and is electrically grounded. A depression 10 to which a plug 2 is joined, is formed in a predetermined position of the body 1. An oil pressure introducing hole 20 to introduce high pressure is connected to the discharge side of the pump cartridge, and opens into the depression 10 such that it is substantially coaxial with it. A low pressure passage 30 formed parallel with the oil pressure introducing hole 20 also opens into the depression 10.

Figure 2:
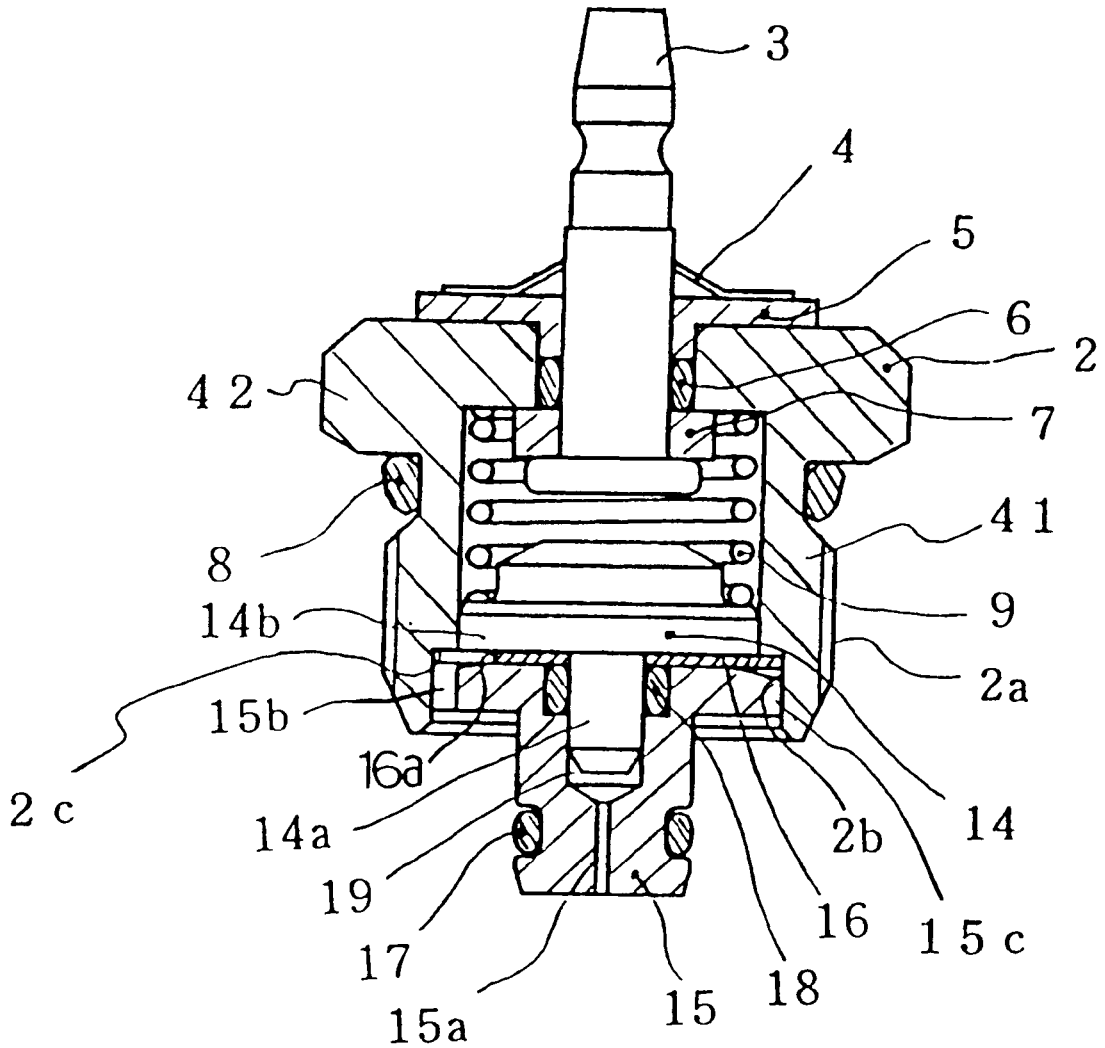
FIG. 2 is a cross sectional view of a plug.

The plug 2 which is installed so as to block the depression 10 comprises a cylindrical part 41, which is tubular-shaped, opening towards the depression 10 as shown in FIG. 1, FIG. 2. A male screw 2*a* is formed in the outer circumference of the cylindrical part 41, and the plug 2 screws into a large diameter part 11 comprising a female screw on the inner circumference of the depression 10 via the male screw 2*a*. An O ring 8 is interposed between the plug 2 and body 1.

A terminal 3 is supported in an insulated state substantially in the center part of the plug 2 via an insulating member 5, O ring 6 and insulating member 7. The terminal 3 is connected to an electrical circuit, not shown. The terminal 3 is prevented from falling in by a push nut 4.

A flange 15*c* of a sleeve 15 is pressed in so that it engages with a large diameter part 2*b* on the inner circumference of the cylindrical part 41 of the plug 2. The sleeve 15 is provided with a damping orifice 15*a* connected to the oil pressure introducing hole 20, and supports a plunger 14 so that it can displace in an axial direction in response to an oil pressure of the oil pressure introducing hole 20 which is introduced via the damping orifice 15*a*. The plunger 14 and sleeve 15 are formed of conducting parts.

The plunger 14 comprises a small diameter part 14*a* and a large diameter part 14*b*. The small diameter part 14*a* engages with and slides on the inner circumference of the sleeve 15. The large diameter part 14*b* engages with the large diameter part 2*b* of the cylindrical part 41, and slides on the inner circumference of the large diameter part 2*b*.

A spring 9 opposing the oil pressure of the oil pressure introducing hole 20 is interposed between the large diameter part 14*b* and a base 42 of the plug 2, and pushes the plunger 14.

An O ring 18 which slides on the small diameter part 14*a* of the plunger 14 is provided on the inner circumference of the sleeve 15. The O ring 18 gives a predetermined frictional force to the plunger 14 which displaces in an axial direction, and suppresses leakage of pressure oil from the damping orifice 15*a* side to the inner circumference of the cylindrical part 41 of the plug 2.

An oil chamber 19 is also formed between the lower end of the small diameter part 14*a* of the plunger 14 and the opening of the damping orifice 15*a* of the sleeve 15.

Notches 15*b* connecting the low pressure passage 30 and the inside of the cylindrical part 41 of the plug 2 are formed on the outer circumference of the flange 15*c* of the sleeve 15. A step 2*c* is formed facing the large diameter part 2*b* in the cylindrical part 41, and a spacer 16 is interposed between the step 2*c* and sleeve 15 to prevent an O ring 17 described hereafter from protruding. Notches 16*a* are formed in a predetermined position of the spacer 16, and the spacer 16 is fitted so that the notches 16*a* and the notches 15*b* of the sleeve 15 face each other. Due to this, oil pressure which has leaked from the slide surfaces of the plunger 14 is led to the low pressure passage 30 via the notches 16*a* and notches 15*b*.

One example of the notches 15*b* formed in the sleeve 15 and the notches 16*a* formed in the spacer 16 is shown in FIG. 5–FIG. 8.

Figure 5:
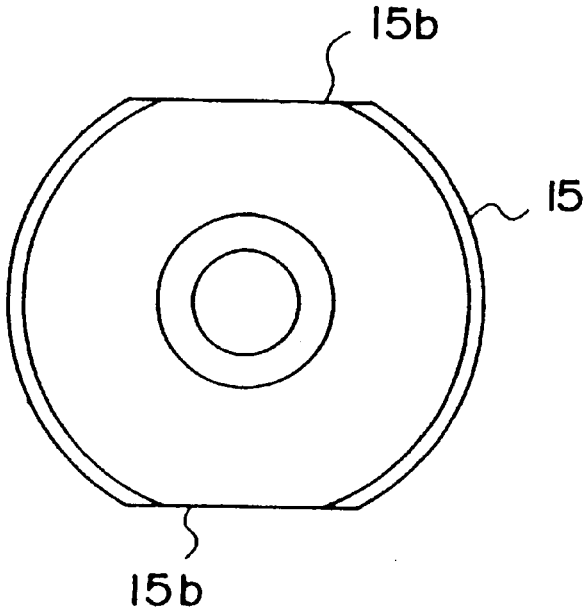
FIG. 5 is a plan view of a sleeve.

As shown in FIG. 5, parallel faces are formed at opposite positions on the side wall of the sleeve 15 so as to form the pair of the notches 15*b* in the flange 15*c* of the sleeve 15. On the other hand, in the spacer 16, three of the notches 16*a* having substantially semicircular shapes are formed at approximately equivalent angular intervals (approximately 120°).

When the notches 15*b* and notches 16*a* are formed in this way, the notches 15*b* and notches 16*a* maintain an effectively constant connection state when they overlap regardless of the positional relationship of the rotation direction. In other words, a passage 50 formed by overlap parts of the notches 15*b* and notches 16*a* maintains approximately equal size even when the positional relationship between the notches 15*b* and notches 16*a* in the rotation direction is different. Therefore, the passage 50 formed by the overlap parts of the notches 15*b* and notches 16*a* which leads oil leaks from the sliding surfaces of the plunger 14 to the low pressure passage 30 always has an effectively constant size even if the positional relationship between the notches 15*b* and notches 16*a* in the rotation direction is not deliberately adjusted.

Figure 4:
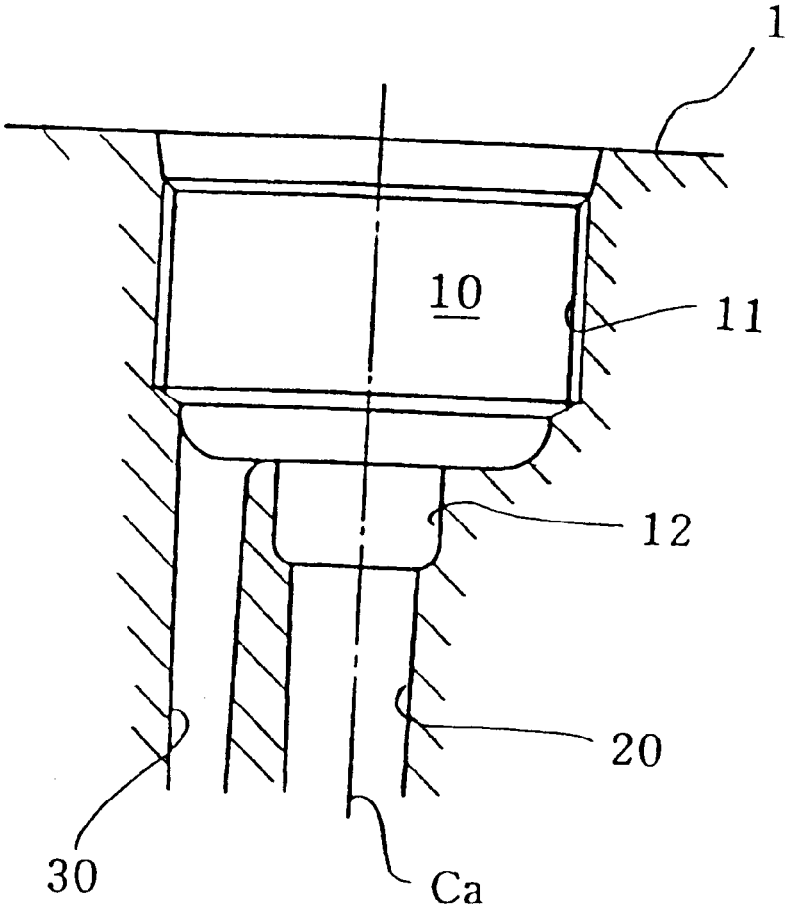
FIG. 4 is a cross sectional view of the body after machining the depression.

The pressure switch having the aforesaid construction is preassembled with the sleeve 15 protruding from the open end of the cylindrical part 41 of the plug 2, as shown in FIG. 2. On the other hand, a small diameter part 12 which engages with the lower end of the sleeve 15 is formed in the depression 10 at a position corresponding to the opening of the oil pressure introducing hole 20 which opens into the large diameter part 11, as shown in FIG. 4. The O ring 17 is provided in the outer circumference of the sleeve 15 which engages with the small diameter part 12 to suppress the leakage of pressure oil from the oil pressure introducing hole 20.

Next, the action of this pressure switch will be described.

As shown in FIG. 1, pressure oil from the oil pressure introducing hole 20 is led to the oil chamber 19 in the sleeve 15 via the damping orifice 15*a*. When the thrust acting on the plunger 14 due to this oil pressure is larger than the pushing force of the spring 9, the plunger 14 displaces to the upper part of the figure, and the upper end of the plunger 14 comes in contact with the terminal 3. The grounded body 1 and terminal 3 therefore become conducting, and an electrical signal switches ON.

When the oil pressure of the oil pressure introducing hole 20 is less than a predetermined value, the spring 9 pushes the plunger 14 back downwards against the thrust of the plunger 14 due to oil pressure, the terminal 3 and plunger 14 separate, and the electrical signal switches OFF.

Due to a predetermined frictional force of the O ring 18 which slides on the small diameter part 14*a* of the plunger 14, hysteresis is produced in the displacement of the plunger 14, and a difference therefore occurs between the oil pressure at which the electrical circuit switches ON and the oil pressure at which it switches OFF. This prevents unnecessary ON-OFF operations in the vicinity of the set pressure of the pressure switch. Further, as the damping orifice 15*a* is interposed between the oil pressure introducing hole 20 and oil chamber 19, faulty operation of the pressure switch due to slight pressure fluctuations of the oil pressure introducing hole 20 caused by pump pulsation, is prevented.

Oil which has leaked to the inner circumference of the cylindrical part 41 of the plug 2 from the sliding surfaces of the small diameter part 14*a* of the plunger 14 and the inner circumference of the sleeve 15, is recirculated to the low pressure passage 30 via the notches 16*a* in the spacer 16, a gap due to a taper surface formed in the flange 15*c* of the sleeve 15, and the notches 15*b* of the sleeve 15.

Oil which has leaked from the O ring 17 interposed between the engaging surfaces of the sleeve 15 and body 1, is likewise recirculated from the base of the depression 10 to the low pressure passage 30.

In assembling the pressure switch, the plug 2 forming the pressure switch is assembled in the body 1 of the hydraulic pump merely by engaging the lower end of the sleeve 15 with the small diameter part 12 formed coaxially with the opening of the oil pressure introducing hole 20, and screwing the male screw 2*a* into the female screw formed in the large diameter part 11 of the body 1. Therefore, when the pump is assembled, a complex sequential assembly of plural parts comprising the pressure switch as in the prior art is not required. As the plug 2, which has been preassembled by assembling the spring 9 and plunger 14 with the sleeve 15 in a separate step, merely has to be screwed in, faulty assembly and falling out of parts which occurred in the prior art is prevented.

Figure 6:
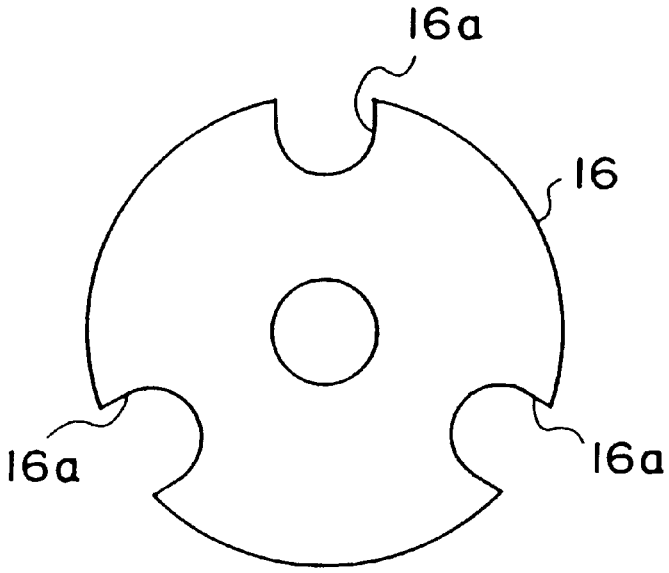
FIG. 6 is a plan view of a spacer.
Figure 7:
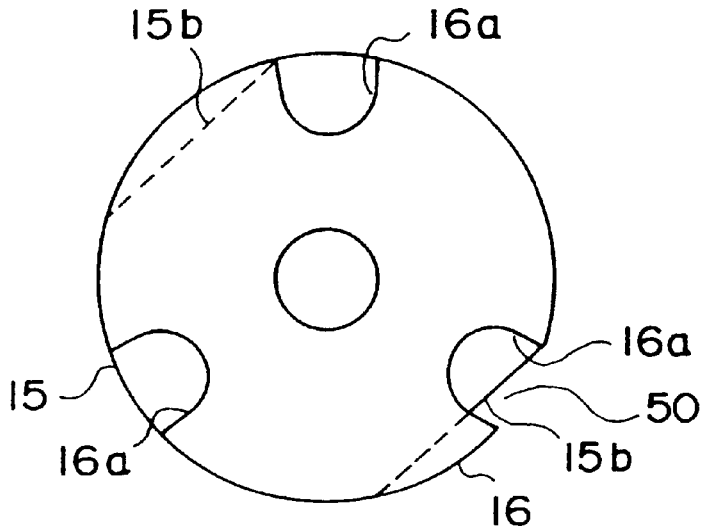
FIG. 7 is a plan view of the sleeve and spacer which overlap.
Figure 8:
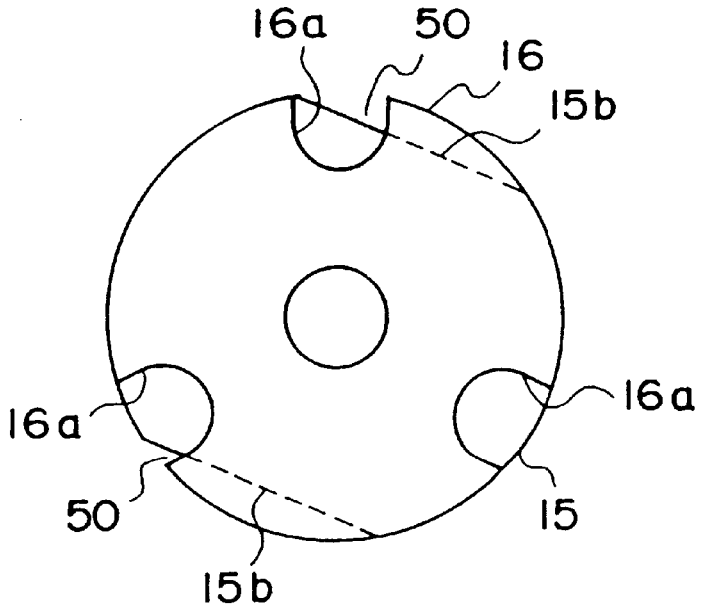
FIG. 8 is a plan view of the sleeve and spacer which overlap.
Figure 9:
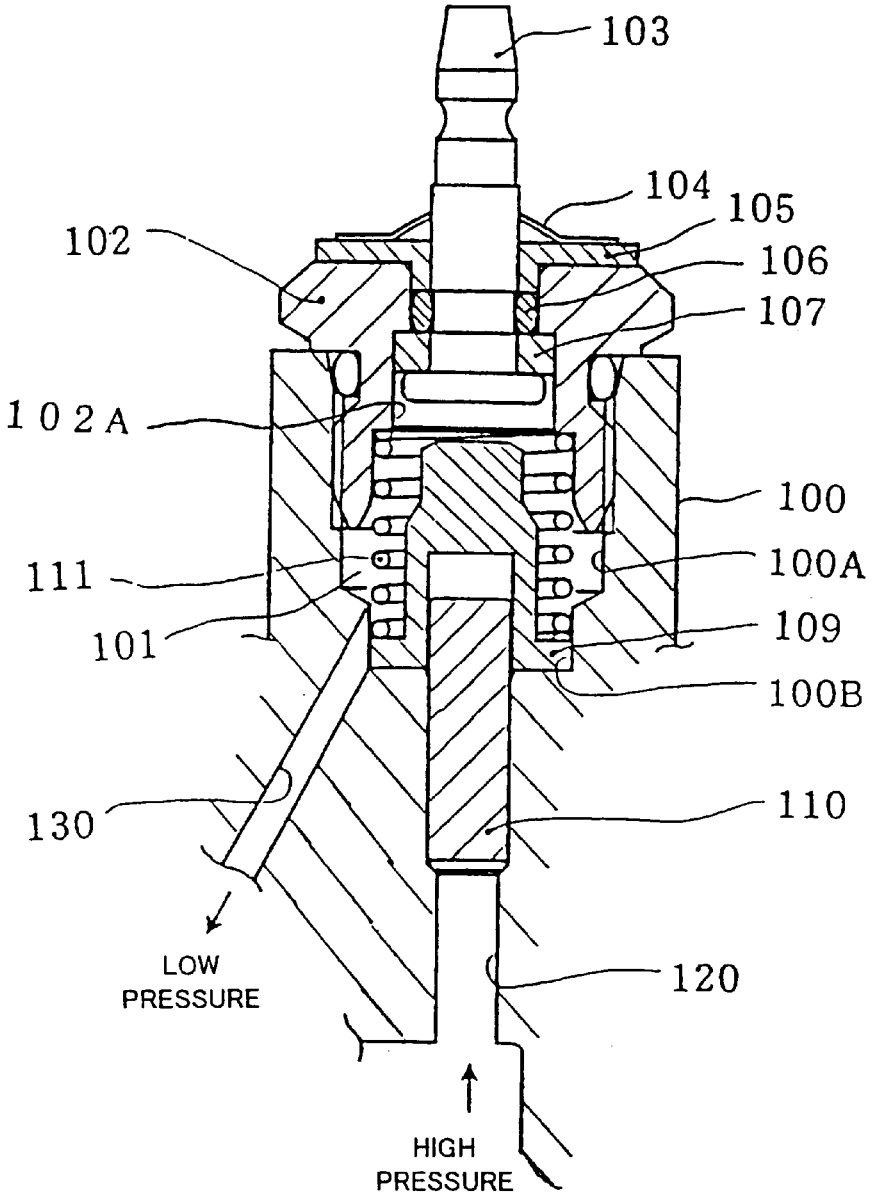
PRIOR ART Fig. 9
FIG. 9 is a cross-sectional view of a conventional pressure switch.
Figure 10:
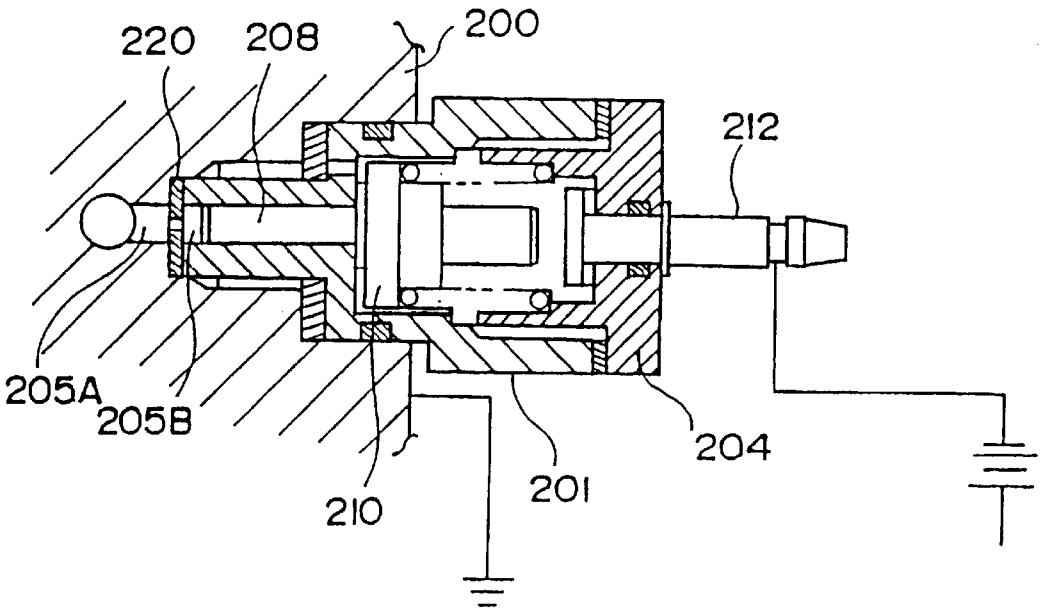
PRIOR ART Fig. 10
FIG. 10 is a cross-sectional view of another conventional pressure switch.

In this case, if the notches 15*b* of the sleeve 15 are formed by two parallel faces as shown in FIG. 5, and the notches 16*a* of the spacer 16 have effectively semicircular shapes and are formed at three positions at equal angles apart as shown in FIG. 6, the passage 50 connected to the low pressure passage 30 formed by the notches 15*b* and notches 16*a*, is always formed with approximately the same size regardless of the positional relationship between the sleeve 15 and spacer 16 in the rotation direction.

Therefore, when the sleeve 15 and spacer 16 are superposed, it is unnecessary to control the positional relationship, and the superposition can be performed very easily.

According to this invention, the parts of the pressure switch can be easily assembled without fail, the number of steps involved in the hydraulic pump assembly is largely reduced, and inspection to deal with faulty assembly as in the prior art does not have to be performed. As a result, productivity is improved, manufacturing costs are largely reduced, and reliability of the pressure switch is increased. Also, as the pressure switch is assembled by screwing in the plug 2, the assembly step may be easily automated by using robots, etc.

Figure 3:
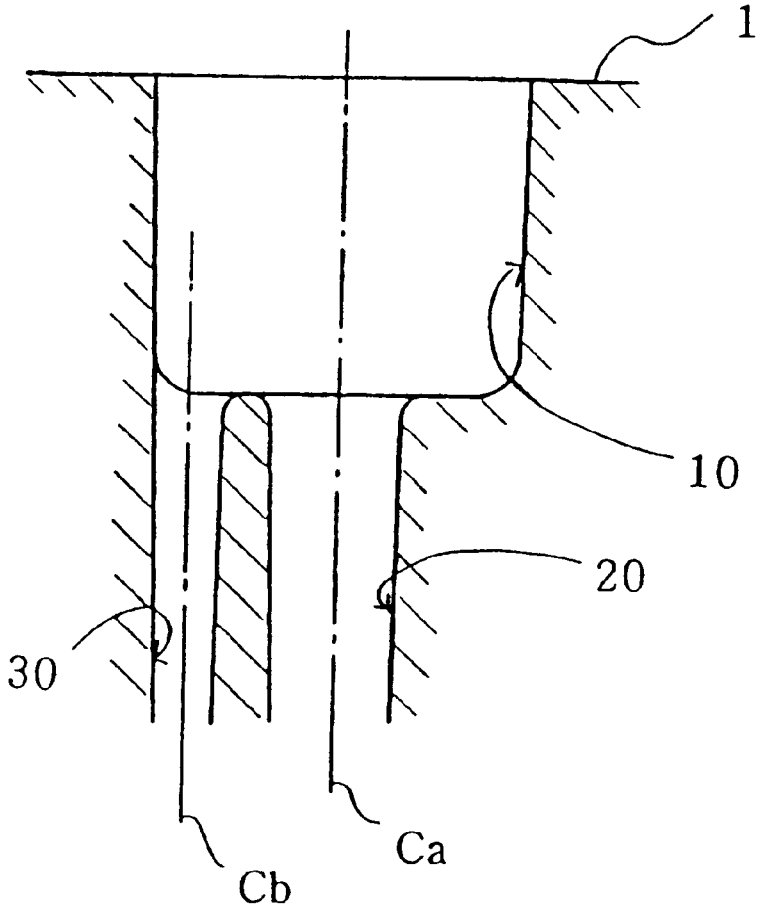
FIG. 3 is a cross sectional view of a body before machining a depression in which the plug is installed.

As the axis of the oil pressure introducing hole 20 is made to coincide with the axis Ca of the depression 10 of the body 1, and the axis Cb of the low pressure passage 30 is arranged parallel to the axis Ca of the oil pressure introducing hole 20 as shown in FIG. 3, the depression 10, oil pressure introducing hole 20 and low pressure passage 30 can be demolded using demolding pins during diecasting. The body 1 has to be machined only at two positions, i.e. the female screw which screws into the plug 2 on the inner circumference of the large diameter part 11, and the small diameter part 12 for receiving the base of the sleeve 15 in the opening of the oil pressure introducing hole 20. Hence, the number of body machining steps to install the pressure switch is largely reduced, and manufacturing costs are further reduced.

Moreover, the hole machining precision of the body 1 has no relationship with the engaging precision of the plunger 14 in the plug 2, so it is very easy to control the detection precision (performance) of the pressure switch and stable precision is achieved.

INDUSTRIAL FIELD OF APPLICATION

As described hereabove, the pressure switch for a hydraulic pump according to this invention is useful as a pressure switch in a vane pump. The number of body machining steps is reduced to the minimum, assembly is easy and reliable, and operating performance is improved.

We claim:

1. A pressure switch for a hydraulic pump comprising:

a depression opening into a body of said hydraulic pump which is electrically grounded, an oil pressure introducing hole for leading a discharge pressure of said pump to said depression, a plug engaging with said depression so as to block an opening of said depression a terminal which is supported in an insulated state by said plug and functions as an output terminal for an electrical signal, and a plunger comprising an electrically conducting member which displaces according to an oil pressure from said oil pressure introducing hole and contacts with said terminal, wherein said electrical signal switches ON or OFF due to the contact of said terminal with said plunger, characterized in that said pressure switch further comprises:

a cylindrical part formed in said plug and opening into said depression in said body, a sleeve comprising an electrically conducting member and housing said plunger, whereof an upper end engages with an open end of said cylindrical part and a lower end faces and engages with an opening of said oil pressure introducing hole, a damping orifice which pierces said sleeve, connects said cylindrical part with said oil pressure introducing hole, and causes an oil pressure from said oil pressure introducing hole to act on said plunger while absorbing minute pressure fluctuations, and a spring housed in said cylindrical part of said plug which pushes said plunger against the oil pressure.

2. A pressure switch according to claim 1, characterized in that a female screw is formed on an inner circumference of said depression, a male screw is formed on an outer circumference of said plug, and an axis of said depression is made to coincide with an axis of said oil pressure introducing hole.

3. A pressure switch according to claim 2, characterized in that a notch for releasing an internal pressure of said plug is formed at a predetermined position of said sleeve, a low pressure passage connecting with said notch is formed in said depression of said body, and said low pressure passage is arranged substantially parallel to said oil pressure introducing hole.

4. A pressure switch according to claim 3, characterized in that said sleeve comprises a cylindrical flange in which notches are formed and a disk-shaped spacer interposed between said flange and said plunger, parallel faces are formed at opposite positions on a wall of said flange so as to form said notches, and plural notches are formed on an outer circumference of said spacer.

5. A pressure switch according to claim 1, characterized in that a notch for releasing an internal pressure of said plug is formed at a predetermined position of said sleeve, a low pressure passage connecting with said notch is formed in said depression of said body, and said low pressure passage is arranged substantially parallel to said oil pressure introducing hole.

6. A pressure switch according to claim 5, characterized in that said sleeve comprises a cylindrical flange in which notches are formed and a disk-shaped spacer interposed between said flange and said plunger, parallel faces are formed at opposite positions on a wall of said flange so as to form said notches, and plural notches are formed on an outer circumference of said spacer.

7. A pressure switch for a hydraulic pump, comprising:

a plug insertable in an opening formed in a body of an electrically-grounded hydraulic pump, so as to block the opening, the plug including a tubular-shaped part that projects into the opening when the plug is engaged with the opening, the tubular-shaped part having an open end that faces the body of the hydraulic pump when the plug is engaged with the opening;

a terminal supported by the plug, and having one end that extends into the tubular-shaped part;

a plunger positioned within the tubular-shaped part, and being displaceable to contact with the one end of the terminal;

a sleeve surrounding at least a portion of the plunger, and having an upper end that engages with the open end of the tubular-shaped part and a lower end that faces and engages with an opening of an oil pressure introducing hole formed in the body of the hydraulic pump when the plug is engaged with the opening formed in the body, the sleeve having a damping orifice formed therein that pierces the sleeve, communicates the tubular-shaped part with the oil pressure introducing hole, and causes an oil pressure from the oil pressure introducing hole to act on the plunger while absorbing minute pressure fluctuations; and a spring housed in the tubular-shaped part which pushes the plunger against an applied oil pressure.

8. The pressure switch defined in claim 7, wherein the sleeve has at least one notch formed therein, the notch allowing pressure developed within the plug to be released.

9. The pressure switch defined in claim 8, wherein the sleeve has a flange having the at least one notch formed therein.

10. The pressure switch defined in claim 8, further comprising a spacer interposed between the upper end of the sleeve and the plunger, the spacer having at least one notch formed on an outer periphery thereof.

11. The pressure switch defined in claim 10, wherein the notch formed in the spacer cooperates with the notch formed in the sleeve to allow the pressure developed within the plug to be released.

12. The pressure switch defined in claim 11, wherein the at least one notch formed in the sleeve comprising a plurality of notches, and the at least one notch formed in the spacer comprises a plurality of notches.

13. The pressure switch defined in claim 12, wherein one of the sleeve and the spacer has two opposing notches, and the other of the sleeve and the spacer has three equally-spaced notches, and wherein at least one of the notches of the sleeve always overlaps at least one of the notches of the spacer, regardless of a rotational positional relationship between the sleeve and the spacer.

14. The pressure switch defined in claim 8, wherein the notch communicates an interior portion of the tubular-shaped part with a low pressure passage formed in the body, when the plug is engaged with the opening formed in the body.

* * * * *